US011035145B2

(12) United States Patent
Smith

(10) Patent No.: US 11,035,145 B2
(45) Date of Patent: Jun. 15, 2021

(54) PORTABLE SUN-SHADE ASSEMBLY

(71) Applicant: JG & AM SMITH INVESTMENTS PTY LTD, Red Hill (AU)

(72) Inventor: Joel Geoffrey Smith, Red Hill (AU)

(73) Assignee: JG + AM Smith Investments Pty Ltd

( * ) Notice: Subject to any disclaimer, the term of this patent is extended or adjusted under 35 U.S.C. 154(b) by 0 days.

(21) Appl. No.: 16/742,661

(22) Filed: Jan. 14, 2020

(65) Prior Publication Data

US 2020/0224447 A1 Jul. 16, 2020

(30) Foreign Application Priority Data

Jan. 15, 2019 (AU) ..... 2019900116

(51) Int. Cl.

| | |
|---|---|
| ***E04H 15/14*** | (2006.01) |
| ***E04H 15/54*** | (2006.01) |
| ***E04H 15/18*** | (2006.01) |
| ***E04H 15/34*** | (2006.01) |
| ***E04H 15/16*** | (2006.01) |
| *E04H 15/20* | (2006.01) |
| *E06B 9/24* | (2006.01) |

(52) U.S. Cl.

CPC ..... *E04H 15/14* (2013.01); *E04H 15/16* (2013.01); *E04H 15/18* (2013.01); *E04H 15/34* (2013.01); *E04H 15/54* (2013.01); *E04H 2015/205* (2013.01); *E06B 2009/2423* (2013.01); *E06B 2009/2447* (2013.01)

(58) Field of Classification Search

CPC ..... E04H 15/18; E04H 15/16; E04H 15/14; E04H 15/54; E04H 15/34; E04H 2015/205; Y10T 428/24744; A47H 23/02; A47H 23/04; A47H 23/06; E06B 2009/2423; E06B 2009/2435

USPC ..... 135/33.7, 93, 94, 115, 119, 120.4; 52/2.22, 2.23, 3, 22, 23, 63, 222, 302.1

See application file for complete search history.

(56) References Cited

U.S. PATENT DOCUMENTS

| | | | | | |
|---|---|---|---|---|---|
| 2,411,316 | A * | 11/1946 | Capita | E04H 6/44 | 52/2.19 |
| 2,527,729 | A * | 10/1950 | Hoff | E04H 15/00 | 135/94 |
| 3,514,613 | A * | 5/1970 | Mashburn | G01R 13/32 | 250/565 |
| 3,670,747 | A * | 6/1972 | Pohl | E04H 15/00 | 135/94 |
| 3,822,844 | A * | 7/1974 | Sutton | B64D 17/025 | 244/145 |

(Continued)

FOREIGN PATENT DOCUMENTS

| | | | | |
|---|---|---|---|---|
| CA | 2252956 A1 * | 10/1999 | ..... | E04H 15/20 |
| GB | 330878 A * | 6/1930 | ..... | B60H 1/262 |
| KR | 483654 Y1 * | 6/2017 | ..... | E04H 15/34 |

*Primary Examiner* — Robert Canfield

(74) *Attorney, Agent, or Firm* — Tumey L.L.P.

(57) ABSTRACT

A portable sunshade assembly comprising: an in-use top flexible sheet spaced away from an in-use bottom flexible sheet wherein during use in an extended configuration the top and bottom flexible sheets comprise respective surfaces and are arranged to define a space there-between to provide a plurality of passages located between the first and second sheets to allow air to pass in a direction from a first side of the top and bottom flexible sheets to a second side of the top and bottom flexible sheets.

16 Claims, 7 Drawing Sheets

(56) References Cited

U.S. PATENT DOCUMENTS 3,936,984 A * 2/1976 Yando ..... E04H 15/20 52/2.19
3,970,096 A * 7/1976 Nicolai ..... E04H 15/14 135/94
4,019,554 A * 4/1977 Rasmussen ..... A01G 9/222 160/84.02
4,024,803 A * 5/1977 Linecker ..... E04H 15/16 454/185
4,165,757 A * 8/1979 Marks ..... E04H 15/32 135/93
4,269,210 A * 5/1981 Marks ..... E04H 15/14 135/125
4,315,962 A * 2/1982 Skoien ..... E04C 2/40 156/297
4,477,503 A * 10/1984 Fraioli ..... E04H 15/22 428/102
4,625,786 A * 12/1986 Carter ..... E06B 9/262 160/268.1
4,878,322 A * 11/1989 Ikeda ..... A01G 9/1415 52/2.18
5,067,505 A * 11/1991 Cantwell ..... E04H 15/40 135/115
5,097,548 A * 3/1992 Heck ..... A47G 9/0215 5/482
5,107,881 A * 4/1992 Feldman ..... E04H 15/36 135/124
5,287,908 A * 2/1994 Hoffmann ..... E06B 9/34 160/121.1
5,392,832 A * 2/1995 Colson ..... E06B 9/262 160/168.1 R
5,415,194 A * 5/1995 Kaye ..... E04H 15/003 135/115
5,784,842 A * 7/1998 Wackerbauer ..... E04B 7/022 52/222
5,878,807 A * 3/1999 Takahashi ..... F28D 1/0213 165/46
6,019,864 A * 2/2000 Jones ..... B26D 1/04 156/182
6,119,408 A * 9/2000 Page ..... E04H 15/22 52/2.23
6,823,923 B2 * 11/2004 Palmer ..... E06B 9/262 160/84.05
6,997,198 B1 * 2/2006 Holtkamp ..... E04H 15/16 135/115
7,774,998 B2 * 8/2010 Aschenbrenner ..... H02S 20/23 52/173.3
9,359,766 B2 * 6/2016 Shiao ..... C09K 21/04
9,441,394 B1 * 9/2016 Holes ..... E04H 15/54
10,900,249 B2 * 1/2021 Dresch ..... E04H 15/16
2002/0056472 A1 * 5/2002 Nanus ..... A45B 25/22 135/33.7
2005/0000555 A1 * 1/2005 Besse ..... E04H 15/14 135/117
2005/0066591 A1 * 3/2005 Worley ..... E04H 15/16 52/138
2006/0272695 A1 * 12/2006 Mettavant ..... E04H 15/40 135/126
2008/0060262 A1 * 3/2008 Lysa ..... A63C 19/12 47/20.1
2010/0325991 A1 * 12/2010 Trower ..... E04C 2/546 52/309.1
2012/0279540 A1 * 11/2012 Jin ..... E04H 15/16 135/94
2013/0118095 A1 * 5/2013 Holes ..... E04H 15/16 52/86
2015/0176283 A1 * 6/2015 Smiley, Jr. ..... E04D 13/172 52/105
2018/0106069 A1 * 4/2018 Larsen ..... E04H 9/16
2018/0251999 A1 * 9/2018 Fraioli, Sr. ..... E04H 15/20
2019/0136614 A1 * 5/2019 Colson ..... D03D 11/02

* cited by examiner

PORTABLE SUN-SHADE ASSEMBLY

TECHNICAL FIELD

The present invention relates to portable shade structures such as sun shades (also known as sunshields) which may be used (but not limited by use) for outdoor recreational activities such as camping.

BACKGROUND

Any references to methods, apparatus or documents of the prior art are not to be taken as constituting any evidence or admission that they formed, or form part of the common general knowledge.

It is common for people to enjoy picknicking and camping in pleasant outdoor locations. Where the weather is hot it may be desirable to make use of a shade cover such as a canopy made from flexible material for use such as tarpaulin. The tarpaulin is used for blocking sunlight and covering any objects or persons positioned under the shade cloth. Typically a large piece of shade cloth having a suitable shape may be positioned on a plurality of tent poles to erect a sun-shade structure. It is also common to position camping tents and other structures below such shade cloths to provide an additional barrier from the sun and rain. One of the problems associated with such sun shade assemblies, as identified by the inventor(s) is that they have a limited effect in controlling the temperature below the shade cloth. Therefore, it is desirable to provide an improved sun-shade assembly that addresses some of the shortcomings of the prior art.

SUMMARY OF INVENTION

In an aspect, the invention provides a portable sunshade assembly comprising: an in-use top flexible sheet spaced away from an in-use bottom flexible sheet wherein during use in an extended configuration the top and bottom flexible sheets comprise respective surfaces and are arranged to define a space there-between to provide a plurality of passages located between the first and second sheets to allow air to pass in a direction from a first side of the top and bottom flexible sheets to a second side of the top and bottom flexible sheets.

In an embodiment, the portable sunshade assembly further comprises:

a first plurality of openings positioned at or adjacent the first side of the flexible sheets for entry of air into the passages; and a second plurality of openings positioned at or adjacent the second side of the flexible sheets to allow air to exit out of said passages.

In an embodiment, the portable sunshade assembly comprises a plurality of internal walls extending between the top and bottom flexible sheets to form side walls defining said passages.

In an embodiment, the plurality of said internal walls are substantially parallel to each other to define said air flow paths positioned in between the top and bottom sheets.

In an embodiment, an in-use upper portion of the internal wall is fastened to the top sheet and an in-use lower portion of the internal wall is fastened to the bottom sheet.

In an embodiment, each of the top and bottom flexible sheets is generally rectangular, each sheet having respective lengths and widths.

In an embodiment, said plurality of internal walls extend generally along the length or along the width of the top and bottom sheets.

In an embodiment, the internal walls extend substantially continuously in a direction from a first end of the top and bottom sheets to a second end of the top and bottom sheets.

In an embodiment, peripheral portions of the top sheet and/or bottom sheets comprise a coupling arrangement to allow the peripheral portions to be coupled to a support member to position the sunshade assembly in a generally upstanding position.

In an embodiment, the coupling arrangement comprises a plurality of eyelets provided along the peripheral portions of the top and/or bottom sheets adapted to receive supporting pins provided on said supporting members.

In an embodiment, corner portions of the top sheets are provided with said eyelets and wherein corner portions of the bottom sheet are provided with a loop fastener for receiving and being fastened to the support members positioned adjacent said corner portions of the top and bottom sheets during use.

Preferably, in a folded or collapsed configuration the spacing between the top and bottom sheets can be reduced to allow the top and bottom sheets of the sunshade assembly to be stowed away.

In an embodiment, the top and/or bottom sheets comprise one or more tensioning members to tension the top and/or bottom sheets during use in the extended configuration.

In an embodiment, the tensioning member comprises a loop provided along an edge portion of the top and/or bottom sheet. The loop may be coupled to the supporting members. The support posts (S) also be coupled to one or more strings to maintain the post (S) in a substantially upright position.

In an embodiment, at least said top sheet and preferably both top and bottom sheets are substantially impermeable to water (water-proof) and sunlight.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
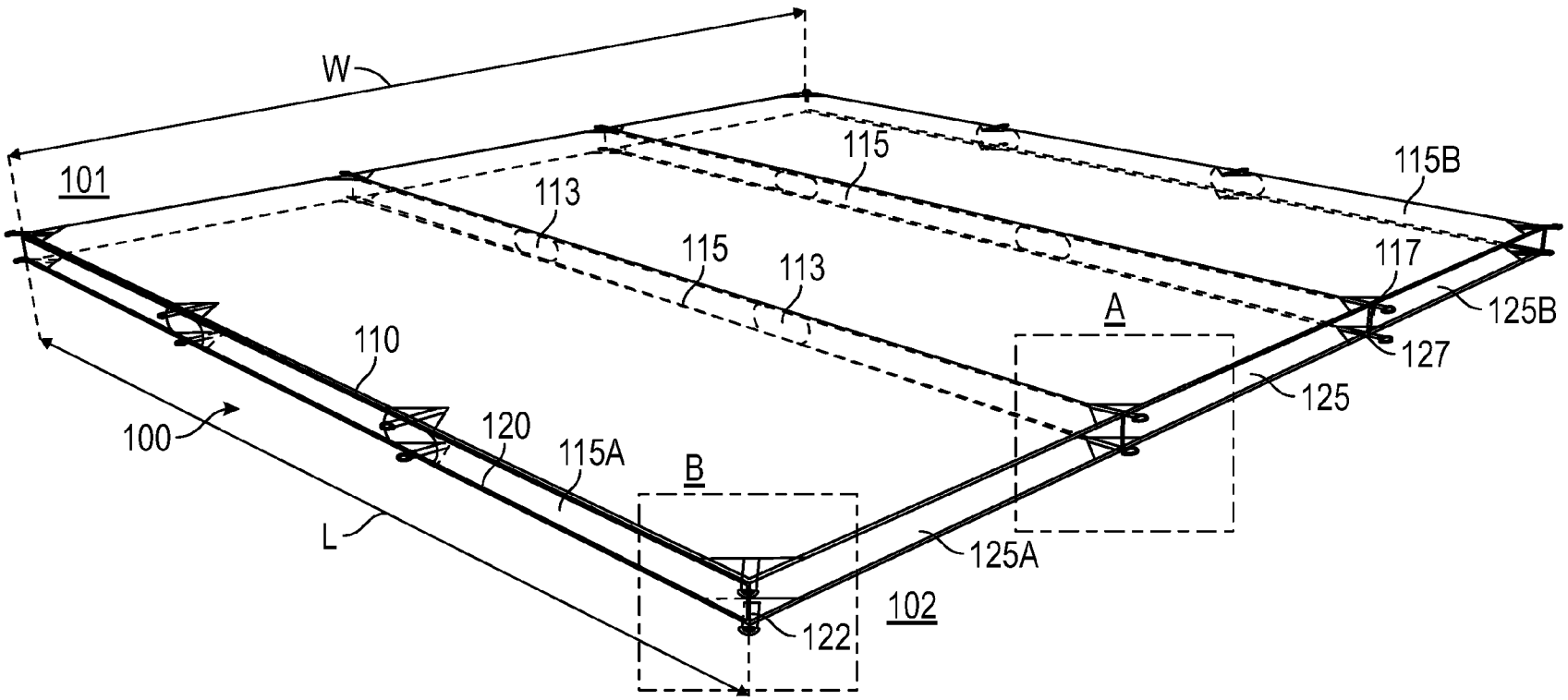
FIG. 1 is a top perspective view (see-through internal view) of a sun-shade assembly 100 in accordance with an embodiment of the present invention.
Figure 2:
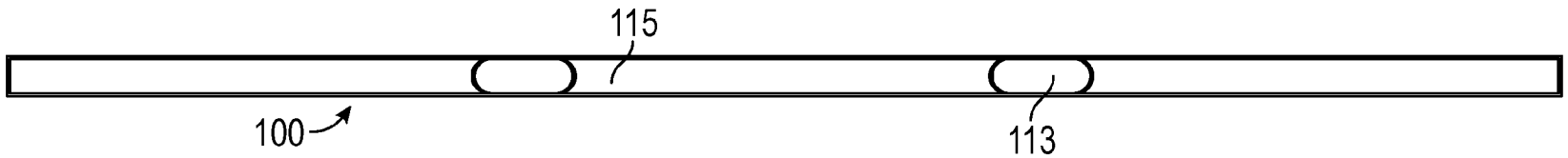
FIG. 2 is a sectional view of the sun-shade assembly 100.
Figure 3:
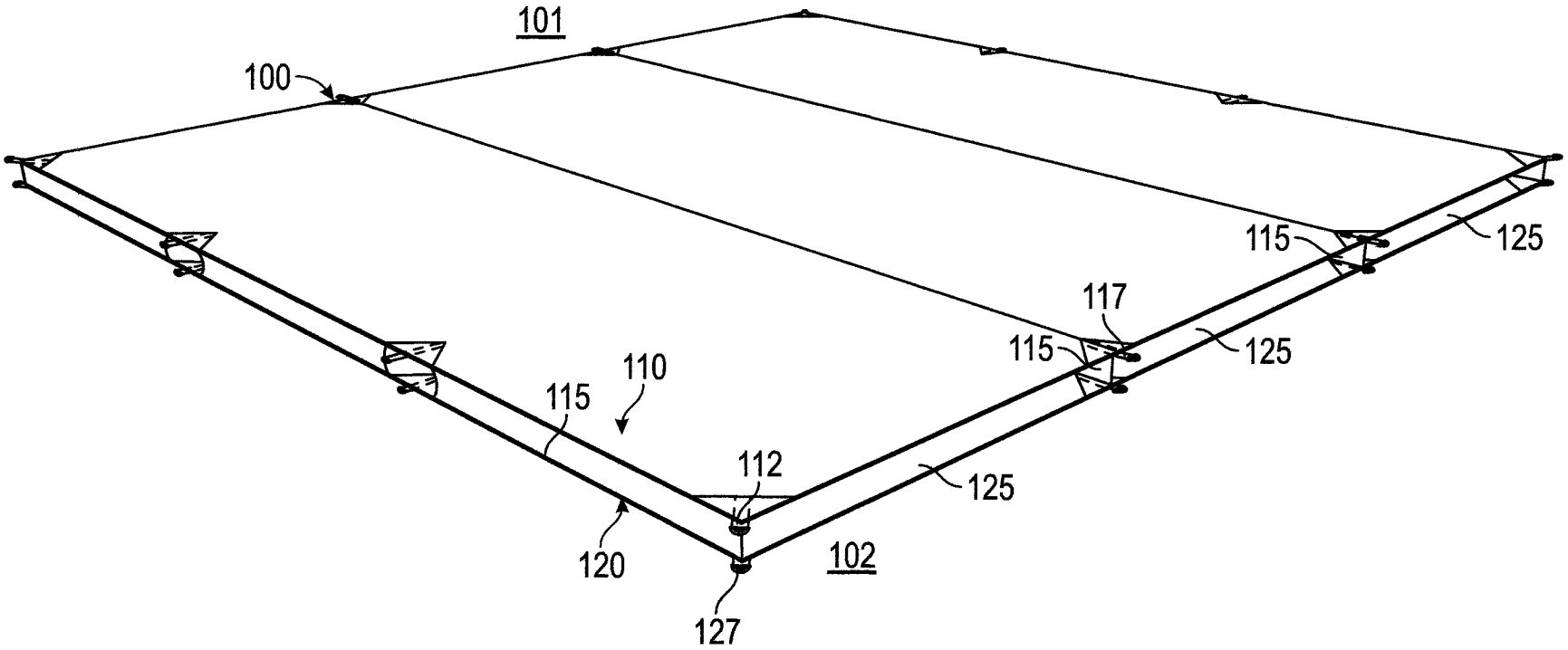
FIG. 3 is a top perspective view of the sun-shade assembly 100.
Figure 4:
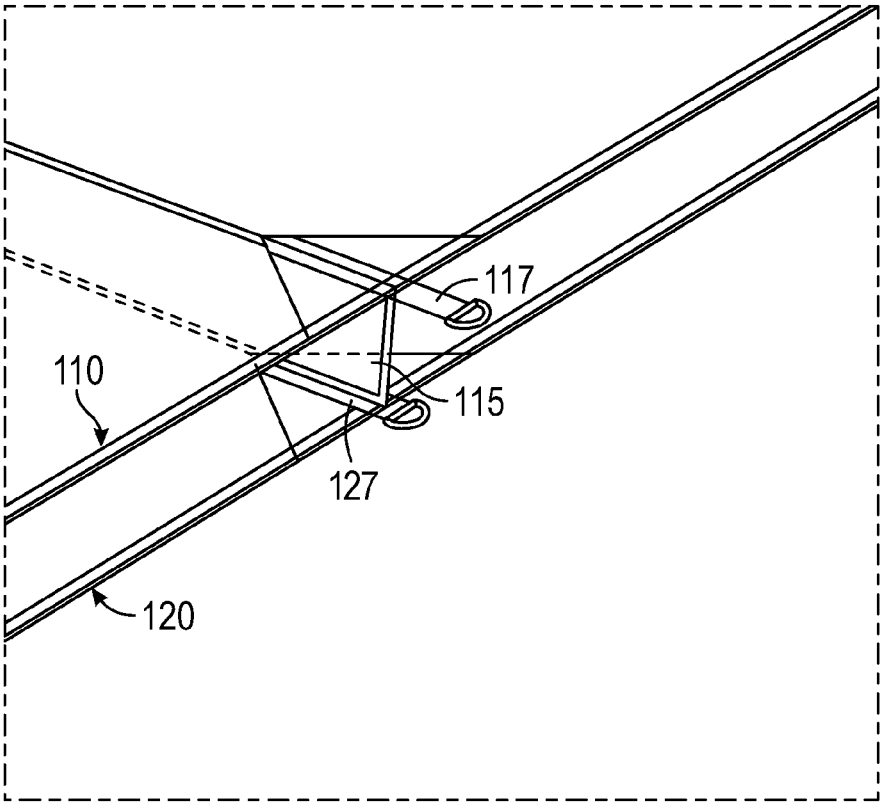
FIG. 4 is an enlarged view of inset A shown in FIG. 1.
Figure 5:
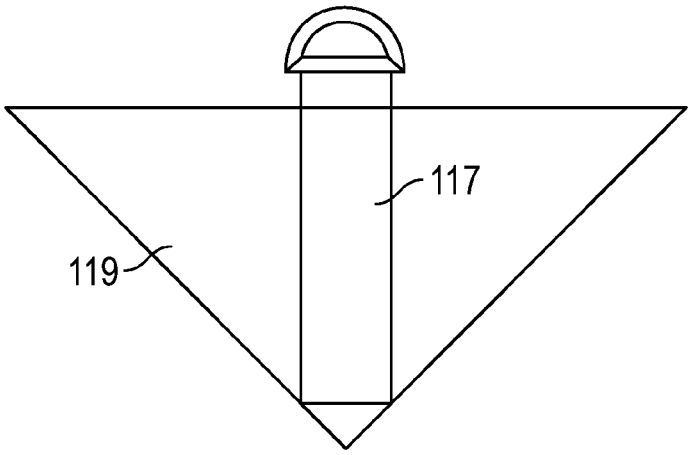
FIG. 5 is an isolated view of side loop strap 117.
Figure 6:
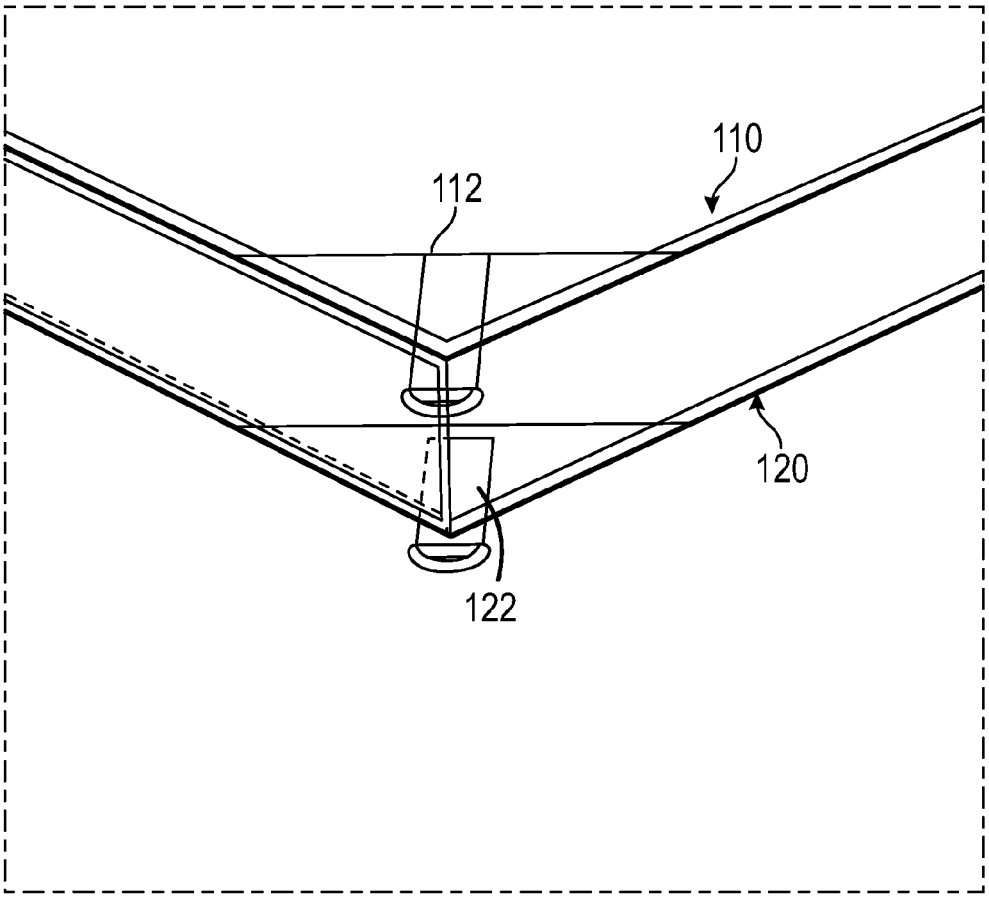
FIG. 6 is an enlarged view of inset B shown in FIG. 1.
Figure 7:
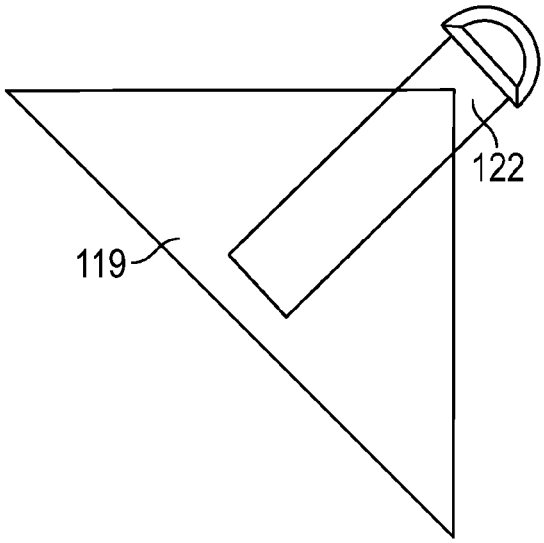
FIG. 7 is an isolated view of corner loop strap 122.
Figure 8:
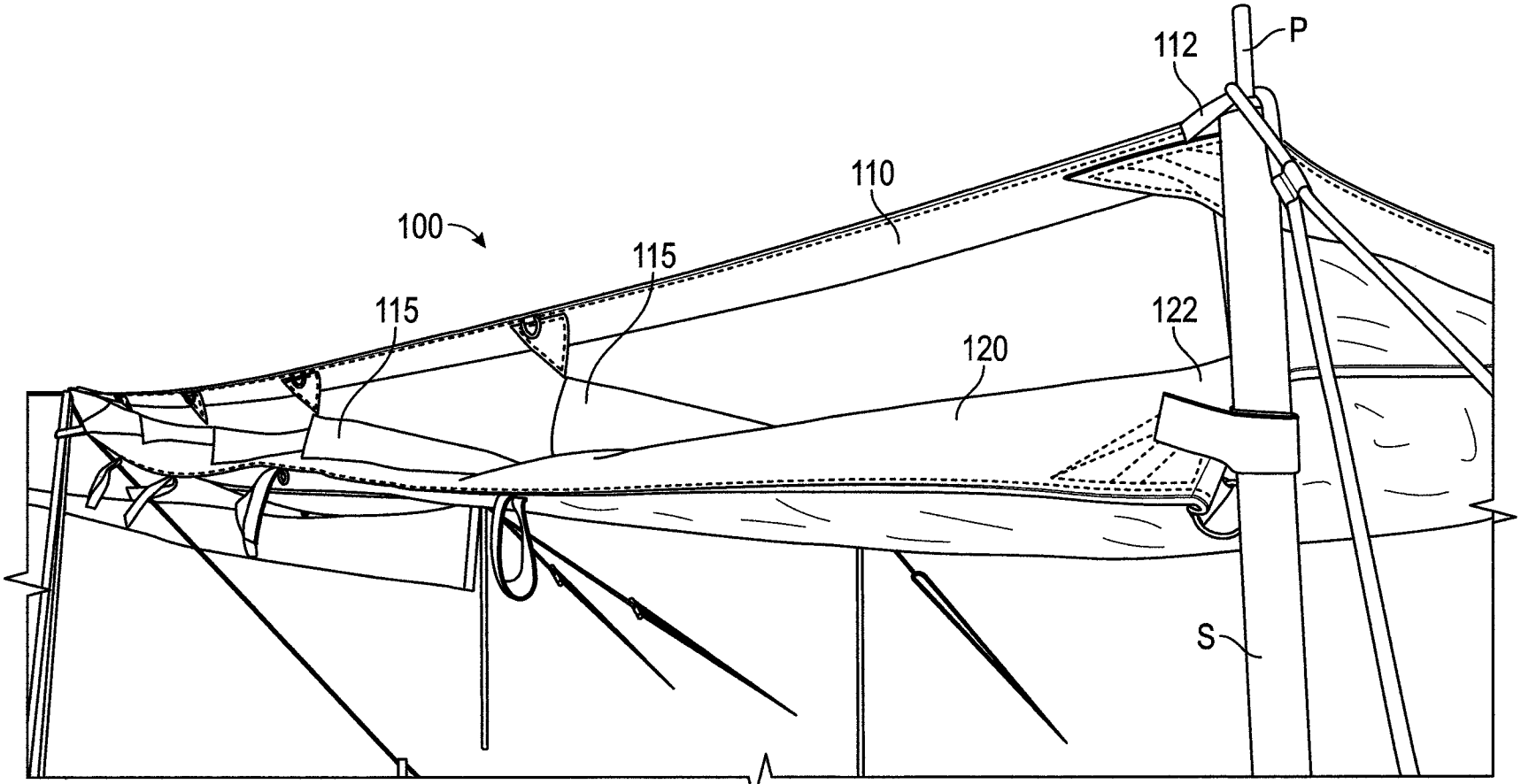
FIG. 8 is an in-use side perspective view of the sun-shade assembly 100.
Figure 9:
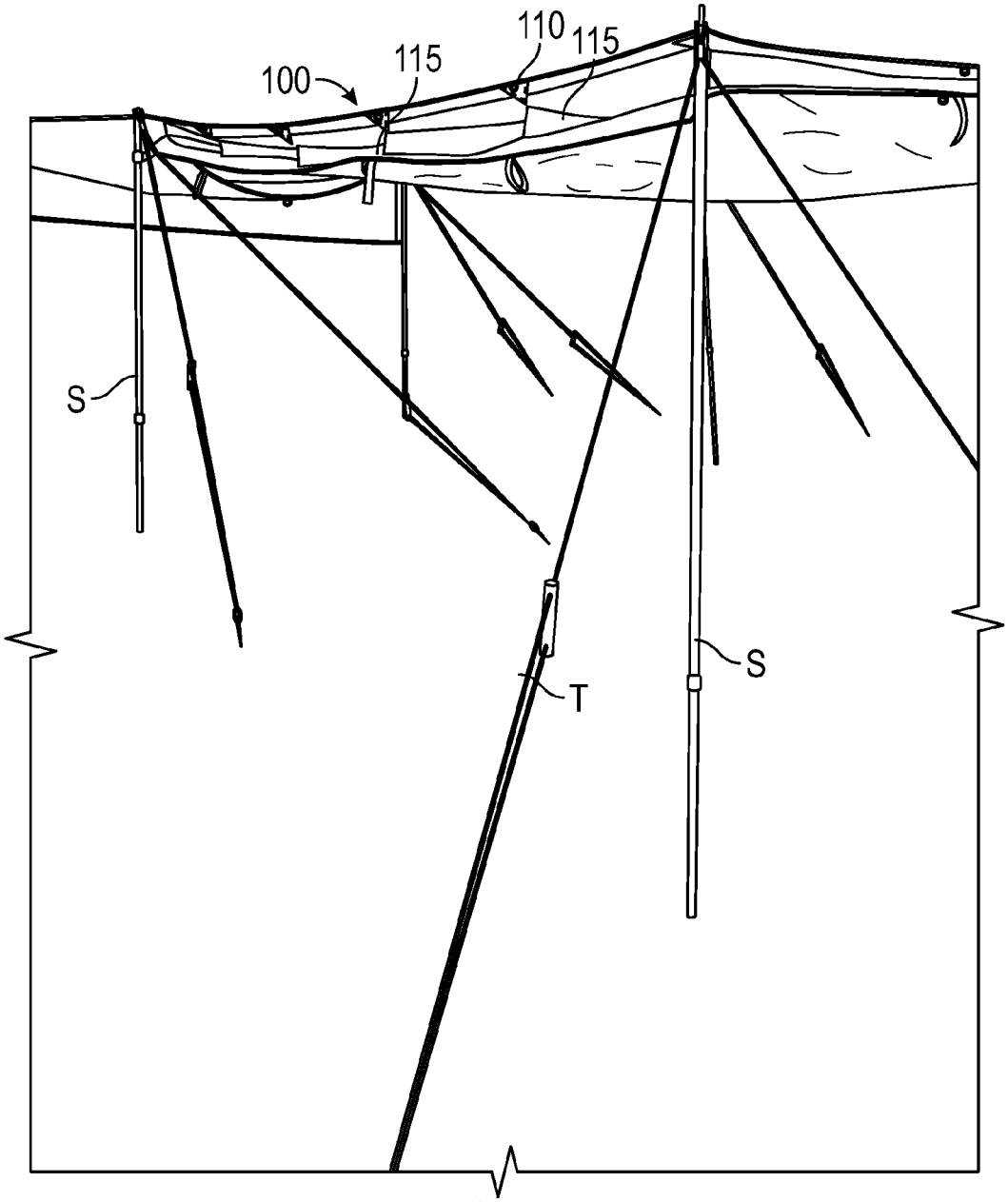
FIG. 9 is a second in-use side perspective view of the sun-shade assembly 100.
Figure 10:
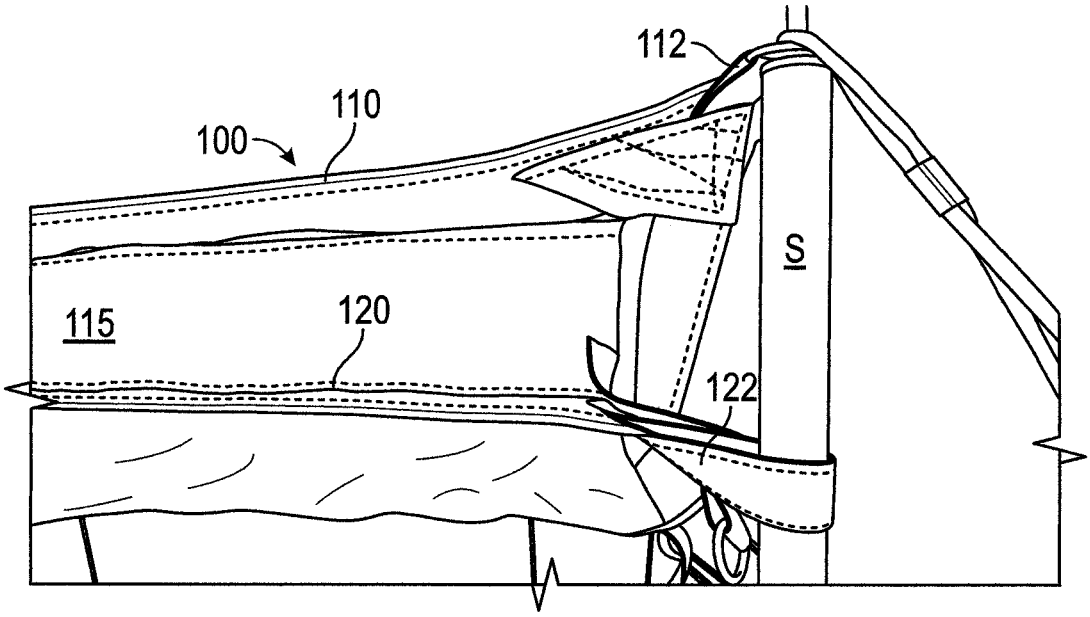
FIG. 10 is an in-use corner view of the sun-shade assembly 100.

FIGS. 1 to 8 illustrate an improved portable sun-shade assembly 100 in accordance with an embodiment of the present invention. The portable sun-shade assembly 100 is made from flexible sheets 110 and 120 which can be spaced apart to allow flow of air between the sheets 110 and 120 when positioned in an extended or unfurled configuration. During periods of non-use, the sheets 110 and 120 can be compressed and folded or rolled in a straightforward manner for stowing.

The advantages of the presently described embodiment of the sun-shade assembly 100 may be well understood by referring to FIGS. 1 to 10 which show the sun-shade assembly 100 in the extended or unfurled configuration. The sun-shade assembly 100 comprises two spaced apart flexible sheets 110 and 120 that are spaced apart to provide a plurality of air flow passages 125 to allow air to pass in a direction from a first side 101 of the top and bottom flexible sheets 110 and 120 to a second side 102 of the top and bottom flexible sheets 110 and 120.

The air flow passages are provided by a plurality of internal walls 115 that extend transversely between the internal surfaces of the two sheets 110 and 120 to interconnect the sheets 110 and 120 to provide the air flow passages 125 extending in a general direction from the first end 101 to a second end 102. In the preferred embodiment, the internal walls 115 are substantially arranged in a parallel and spaced apart arrangement to provide parallel air passages that in turn provide a plurality of air flow passages in between the two sheets 110 and 120. Whilst, the preferred embodiment illustrates parallel internal walls 115 it must be understood that internal walls 115 may be arranged in other non-parallel arrangements without departing from the scope of the presently described invention. Furthermore, non-continuous internal walls (that do not extend for the entire length or width of the sheets 110 and 120) may also be provided in alternative embodiments. By way of example, the internal walls 115 may only extend for half the length (L) of the top and bottom sheets 110 and 120. Lateral side walls denoted by 115A and 115B with a height (h) [extend between lateral side portions of the top sheet 110 and bottom sheet 120] and a length (I) [extending between the first side 101 and the second side 102] also form the walls for defining respective air flow passages 125 (best shown in FIG. 1). Lateral side wall 115A forms one of the walls for a first passage 125A located adjacent the first lateral side of the top and bottom sheets 110 and 120. Similarly, lateral side wall 115B forms one of the walls for a second passage 125B that is located adjacent the second lateral side of the top and bottom sheets 110 and 120.

The internal walls 115 also comprise a plurality of oval openings 113 to allow air to flow between adjacently arranged passages 125. It would be understood that the number of the openings provided in the internal walls 115 may be varied. Moreover, the shape of the openings 113 is also not limited.

Referring to FIG. 1 and without being bound by theory, the inventors have hypothesized that the provision of the air flow passages 125 allows air to flow into the passage from a first end 101 of the sun-shade assembly and flow out of the second end 102 of the sunshade assembly 100. The flow of the air through the air flow passages 125 provides a cooling effect by allowing cooler air to flow into the space in between top and bottom sheets 110 and 120. The inventors have carried out some preliminary experiments and noted that the provision of the sun shade assembly 100 can significantly reduce temperature under the sun-shade assembly 100. Therefore, the provision of the spacing between the top and bottom sheets 110 and 120 in combination with the internal walls 115 that form air flow passages 125 provides the advantageous effect of cooling the spacing between the top and bottom sheets 110 and 120. The provision of the internal walls 115 also provides a reinforcing effect to the sun-shade assembly 100 and results in uniform thickness or spacing between the top and bottom sheets 110 and 120. The spacing between the top and bottom sheets 110 and 120 also controls the volume of air that can flow in between the top and bottom sheets 110 and 120 thereby preventing the top and bottom sheets 110 and 120 from becoming separated due to sudden flow of air in between the top and bottom sheets 110 and 120.

In the preferred embodiment, the spaced apart top and bottom sheets 110 are rectangular having a length (L) and a width (W). However, the invention is not limited by shape and the top and bottom sheets may be provided any regular or non-regular shape or size. By way of example, the top and bottom sheets 110 and 120 may be circular in some embodiments. In other embodiments, the top and bottom sheets may be in the shape of a regular or irregular polygon.

This to FIGS. 6 to 7 and 8 to 10, the sun-shade assembly 100 may be erected by being supported at corner portions by supporting posts S. Each corner of the top and bottom sheets 110 and 120 is provided with coupling arrangements 119 in the form of respective straps 112 and 122 that are attached to the top and bottom sheets 110 and 120. The straps 112 and 122 each include eyelets or reinforced openings which are adapted to receive supporting pins (P) positioned on respective top portions of the support posts (S). Once again, the coupling arrangement 119 is provided to couple the supporting posts (S) with the sun-shade assembly 100 may be varied without departing from the scope of the invention described herein. The coupling arrangement 119 also include straps 117 and 127 that are attached along respective peripheral side portions of the top and bottom sheets 110 and 120. Each of the straps 117 and 127 also include eyelets or reinforced openings that can receive supporting pins (P) on top of supporting posts (S) to attach the top and bottom sheets 110 and 120 to the supporting posts (S). Additionally, the Tensioning ropes (T) may be fastened to the supporting posts (S) to maintain the posts (S) in a substantially upright position.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

What is claimed is:

1. A portable sunshade assembly comprising:

an in-use bottom flexible sheet;

an in-use top flexible sheet spaced away from the in-use bottom flexible sheet, wherein during use in an extended configuration the top and bottom flexible sheets comprise respective surfaces and are arranged to define a space there-between, the top and bottom flexible sheets partially defining a plurality of elongate passages located there between to allow air to pass in a direction from a first side of the top and bottom flexible sheets to a second side of the top and bottom flexible sheets;

a first plurality of openings positioned at or adjacent the first side of the flexible sheets for entry of air into the elongate passages;

a second plurality of openings positioned at or adjacent the second side of the flexible sheets to allow air to exit out of said elongate passages, wherein the first plurality of openings and the second plurality of openings are at least partially defined by the top and bottom flexible sheets;

a coupling arrangement to allow peripheral portions of the top sheet, bottom sheet or both the top and bottom sheets to be coupled to a support member to position the sunshade assembly in a generally upstanding position and, wherein the coupling arrangement comprises a plurality of eyelets provided along straps attached to peripheral portions of the top and/or bottom sheets adapted to receive supporting pins provided on said supporting members.

2. The portable sunshade assembly in accordance with claim 1 further comprising a plurality of internal walls extending between the top and bottom flexible sheets to define said passages.

3. The portable sunshade assembly in accordance with claim 2 wherein the plurality of said internal walls are substantially parallel to each other to define said passages positioned in between the top and bottom sheets.

4. A portable sunshade assembly in accordance with claim 3 wherein the internal walls extend substantially continuously in a direction from the first end of the top and bottom sheets to the second end of the top and bottom sheets.

5. The portable sunshade assembly in accordance with claim 2 wherein an in-use upper portion of the internal walls is fastened to the top sheet and an in-use lower portion of the internal walls is fastened to the bottom sheet.

6. The portable sunshade assembly in accordance with claim 2 wherein the plurality of internal walls comprises one or more openings to allow air to flow between adjacently arranged passages.

7. The portable sunshade assembly in accordance with claim 1 further comprising lateral side walls having a height extending between lateral side portions of the top sheet and bottom sheen and a length extending between the first and second sides.

8. The portable sunshade assembly in accordance with claim 7 wherein at least one lateral side wall forms an internal wall for one of the plurality of passages.

9. The portable sunshade assembly in accordance with claim 8 wherein at least a first side wall forms an internal wall for a first air flow passage and a second side wall forms another internal wall for a second air flow passage.

10. A portable sunshade assembly in accordance with claim 2 wherein each of the top and bottom flexible sheets is generally rectangular, each sheet having respective lengths and widths.

11. A portable sunshade assembly in accordance with claim 10 wherein said plurality of internal walls extend generally along the length or along the width of the top and bottom sheets.

12. A portable sunshade assembly in accordance with claim 1 wherein corner portions of the top and bottom sheets are provided with said eyelets along straps for receiving and being fastened to the support members positioned adjacent said corner portions of the top and bottom sheets during use.

13. A portable sunshade assembly in accordance with claim 1 wherein in a folded or collapsed configuration the spacing between the top and bottom sheets can be reduced to allow the top and bottom sheets of the sunshade assembly to be stowed away.

14. A portable sunshade assembly in accordance with claim 1 wherein the top and/or bottom sheets comprise one or more loop fasteners to tension the top and/or bottom sheets during use in the extended configuration.

15. A portable sunshade assembly in accordance with claim 14 wherein the loop fasteners comprises a loop provided along an edge portion of the top and/or bottom sheet for allowing the top and/or bottom sheet to be coupled to the support member, in the form of a supporting post.

16. A portable sunshade assembly in accordance with claim 1 wherein at least said top sheet or both top and bottom sheets are substantially impermeable to water.

* * * * *